US008500510B2

(12) United States Patent
Nuttall et al.

(10) Patent No.: US 8,500,510 B2
(45) Date of Patent: Aug. 6, 2013

(54) FLOATING TOY

(75) Inventors: Michael Nuttall, South Pasadena, CA (US); Stacy Lynn O'Connor, Long Beach, CA (US); John Violette, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 31 days.

(21) Appl. No.: 13/312,985

(22) Filed: Dec. 6, 2011

(65) Prior Publication Data

US 2012/0178336 A1 Jul. 12, 2012

Related U.S. Application Data

(63) Continuation-in-part of application No. 12/766,796, filed on Apr. 23, 2010, now Pat. No. 8,251,768, and a continuation-in-part of application No. 13/098,874, filed on May 2, 2011, now Pat. No. 8,221,184.

(60) Provisional application No. 61/173,105, filed on Apr. 27, 2009, provisional application No. 61/329,928, filed on Apr. 30, 2010.

(51) Int. Cl.
*A63H 23/00* (2006.01)

(52) U.S. Cl.
USPC ..... 446/153; 446/166

(58) Field of Classification Search
USPC ..... 446/153, 156, 157, 173, 174, 429, 446/430, 433, 435, 444, 445, 448, 473
See application file for complete search history.

(56) References Cited

U.S. PATENT DOCUMENTS

| | | | |
|---|---|---|---|
| 1,715,891 | A | 6/1929 | Beck |
| 1,893,507 | A | 1/1933 | Ranney |
| 3,204,574 | A | 9/1965 | Frisbie et al. |
| 3,209,491 | A | 10/1965 | Roeper |
| 3,359,920 | A | 12/1967 | Iammatteo |
| 3,577,675 | A | 5/1971 | Kohner et al. |
| 3,858,875 | A | 1/1975 | Nemeth et al. |

(Continued)

FOREIGN PATENT DOCUMENTS

| | | | |
|---|---|---|---|
| JP | 2005118297 | A | 5/2005 |
| JP | 2009268895 | A | 11/2009 |

OTHER PUBLICATIONS

International Search Report for International Application No. PCT/US2010/032302 mailed Feb. 9, 2011.

(Continued)

*Primary Examiner* — Nini Legesse
(74) *Attorney, Agent, or Firm* — Cantor Colburn LLP

(57) ABSTRACT

A floatable toy structure is disclosed herein, the floatable toy structure having a floatable base portion; a collapsible track section, the collapsible track section having a pair of track sections; a collapsible support secured to the floatable base portion, the collapsible support capable of being positioned in an extended position and a stowed position, the collapsible support extending upwardly from the floatable base portion when it is in the extended position, the collapsible support engages and maintains the collapsible track section in an extended position when the collapsible support is in the extended position; and a fair start mechanism for simultaneously releasing a pair of objects for travel down the pair of track sections, wherein the fair start mechanism comprises a bucket that spills water onto the pair of objects after a predetermined amount of water has been placed into the bucket.

20 Claims, 10 Drawing Sheets

(56) References Cited

U.S. PATENT DOCUMENTS

| | | | | |
|---|---|---|---|---|
| 3,908,989 | A | 9/1975 | Meyer | |
| 3,987,581 | A | 10/1976 | Brown | |
| 4,094,089 | A | 6/1978 | Sano | |
| 4,185,409 | A | 1/1980 | Cheng | |
| 4,223,894 | A | 9/1980 | Fabricant | |
| 4,235,378 | A | 11/1980 | Melin et al. | |
| 4,249,733 | A | 2/1981 | Eddins et al. | |
| 4,348,028 | A | 9/1982 | Barlow | |
| 4,355,807 | A | 10/1982 | Prehodka | |
| 4,513,966 | A | 4/1985 | Mucaro et al. | |
| 4,536,168 | A | 8/1985 | Stephens | |
| 4,585,166 | A | 4/1986 | Stephens | |
| D305,676 | S | 1/1990 | Ngai | |
| 5,336,122 | A | 8/1994 | Lewis | |
| 5,683,298 | A | 11/1997 | Jackson | |
| 6,216,600 | B1 | 4/2001 | Verret | |
| 6,905,388 | B2 | 6/2005 | Schoonmaker | |
| 7,618,302 | B2 | 11/2009 | Collins et al. | |
| 7,690,964 | B2 | 4/2010 | Nuttall et al. | |
| 8,221,184 | B2 * | 7/2012 | Nuttall et al. | 446/153 |
| 8,251,768 | B2 * | 8/2012 | Nuttall | 446/153 |
| 2005/0176338 | A1 | 8/2005 | Delaney | |
| 2005/0287916 | A1 | 12/2005 | Sheltman et al. | |
| 2006/0128256 | A1 | 6/2006 | Collins et al. | |
| 2007/0049160 | A1 | 3/2007 | Matthes et al. | |
| 2007/0197127 | A1 | 8/2007 | Ostendorff et al. | |
| 2007/0293123 | A1 | 12/2007 | Nuttall et al. | |
| 2008/0009219 | A1 | 1/2008 | Nuttall et al. | |
| 2008/0020675 | A1 | 1/2008 | Ostendorff | |
| 2008/0081536 | A1 | 4/2008 | Payne et al. | |
| 2009/0004949 | A1 | 1/2009 | Payne | |
| 2010/0304639 | A1 | 12/2010 | Payne et al. | |

OTHER PUBLICATIONS

Written Opinion of the International Searching Authority for International Application No. PCT/US2010/032302 mailed Feb. 9, 2011.

International Search Report dated Feb. 9, 2012 for Internation Application No. PCT/US2011/034791.

Written Opinion dated Feb. 9, 2012 for Internation Application No. PCT/US2011/034791.

* cited by examiner

FLOATING TOY

CROSS REFERENCE TO RELATED APPLICATIONS

This application is a continuation in part of U.S patent application Ser. No. 12/766,796, filed on Apr. 23, 2010, which claims the benefit of U.S. Provisional Patent Application Ser. No. 61/173,105 filed on Apr. 27, 2009, the contents each of which are incorporated herein by reference thereto.

This application is also a continuation in part of U.S patent application Ser. No. 13/098,874, filed on May 2, 2011, which claims the benefit of U.S. Provisional Patent Application Serial No. 61/329,928 filed Apr. 30, 2010, the contents each of which are incorporated herein by reference thereto

BACKGROUND

Various embodiments of the present invention are related to toys in particular, a floating structure for use with toy vehicles.

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, it is desirable to add track amusement features to the track sets. Furthermore, you children enjoy playing with toys in the water whether it is a tub, pool, beach etc.

Accordingly, it is desirable to provide a toy structure that will provide variations in play and is capable of being used in a body of water.

SUMMARY OF THE INVENTION

In one embodiment, a floatable toy structure is provided, the floatable toy structure having a floatable base portion; a collapsible track section secured to the floatable base portion, the collapsible track section capable of being positioned in an extended position and a stowed position, the collapsible track section extending upwardly from the floatable base portion when it is in the extended position; and a collapsible support secured to the floatable base portion, the collapsible support capable of being positioned in an extended position and a stowed position, the collapsible support extending upwardly from the floatable base portion when it is in the extended position, the collapsible support engages and maintains the collapsible track section in the extended position when the collapsible support is in the extended position.

In another embodiment, a floatable toy structure is disclosed herein, the floatable toy structure having a floatable base portion; a collapsible track section secured to the floatable base portion, the collapsible track section capable of being positioned in an extended position and a stowed position, the collapsible track section extending upwardly from the floatable base portion when it is in the extended position, the collapsible track section having a pair of track sections; a collapsible support secured to the floatable base portion, the collapsible support capable of being positioned in an extended position and a stowed position, the collapsible support extending upwardly from the floatable base portion when it is in the extended position, the collapsible support engages and maintains the collapsible track section in the extended position when the collapsible support is in the extended position; and a fair start mechanism for simultaneously releasing a pair of objects for travel down the pair of track sections, wherein the fair start mechanism comprises a bucket that spills water onto the pair of objects after a predetermined amount of water has been placed into the bucket.

In another embodiment, a floatable toy structure is provided, the floatable toy structure having: a floatable base portion; a collapsible track section secured to the floatable base portion, the collapsible track section capable of being positioned in an extended position and a stowed position, the collapsible track section extending upwardly from the floatable base portion when it is in the extended position, the collapsible track section having a pair of track sections; a collapsible support secured to the floatable base portion, the collapsible support capable of being positioned in an extended position and a stowed position, the collapsible support extending upwardly from the floatable base portion when it is in the extended position, the collapsible support engages and maintains the collapsible track section in the extended position when the collapsible support is in the extended position; and a fair start mechanism for simultaneously releasing a pair of objects for travel down the pair of track sections, wherein the fair start mechanism comprises a bucket that spills water onto the pair of objects after a predetermined amount of water has been placed into the bucket, wherein the spilled water is received onto a tray member pivotally mounted to an underside of the collapsible track section and the tray member pivots from a first holding position to a second release position such that the pair of objects are released down the pair of track sections when the tray member is in the second release position.

In another embodiment, a method for simultaneously releasing a pair of toy vehicles down a pair of track sections of a floatable toy structure is provided, the method including the steps of: pivotally mounting a bucket to a support of the floatable toy structure, wherein the bucket is configured to change its center of gravity as the bucket is filled with water; pivotally mounting a tray member to an underside the pair of track sections, wherein the tray member pivots from a first holding position to a second release position such that the pair of vehicles are released down the pair of track sections when the tray member is in the second release position; and moving the tray member from the first holding position to the second release position by pouring water from the bucket onto the tray member, wherein the tray member has a pair of members that are drawn into a pair of slots of the pair of track sections when the tray member is moved from the first position to second position

DETAILED DESCRIPTION

Figure 1:
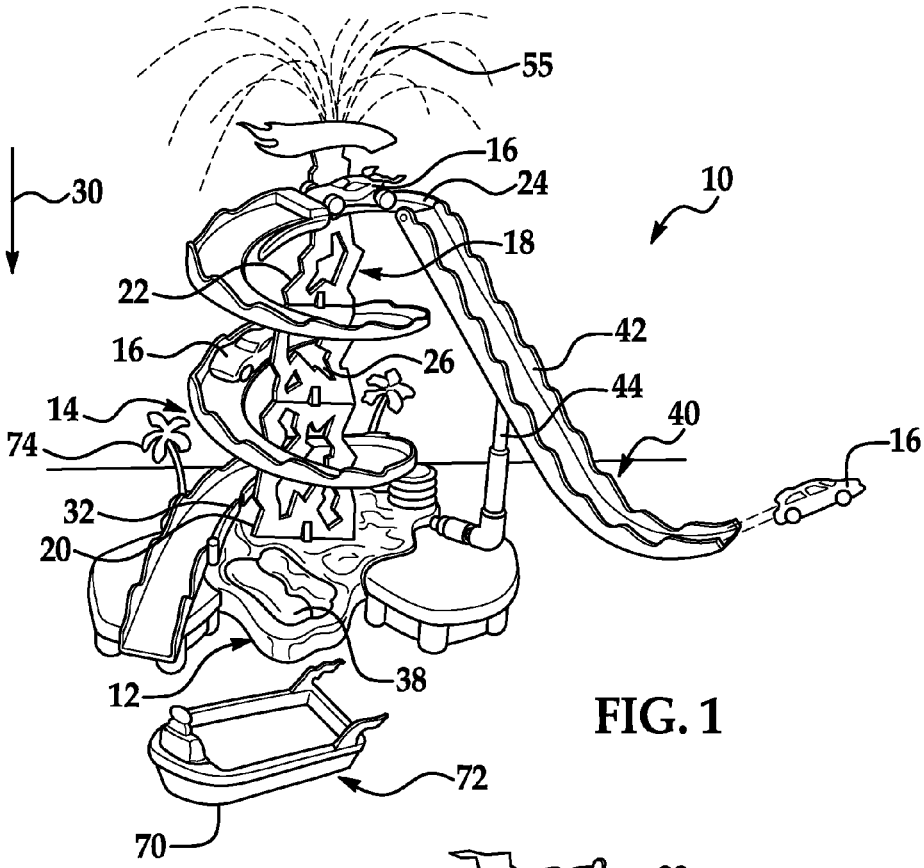
FIGS. 1-4 are perspective views of a toy structure in accordance with an exemplary embodiment of the present invention.
Figure 2:
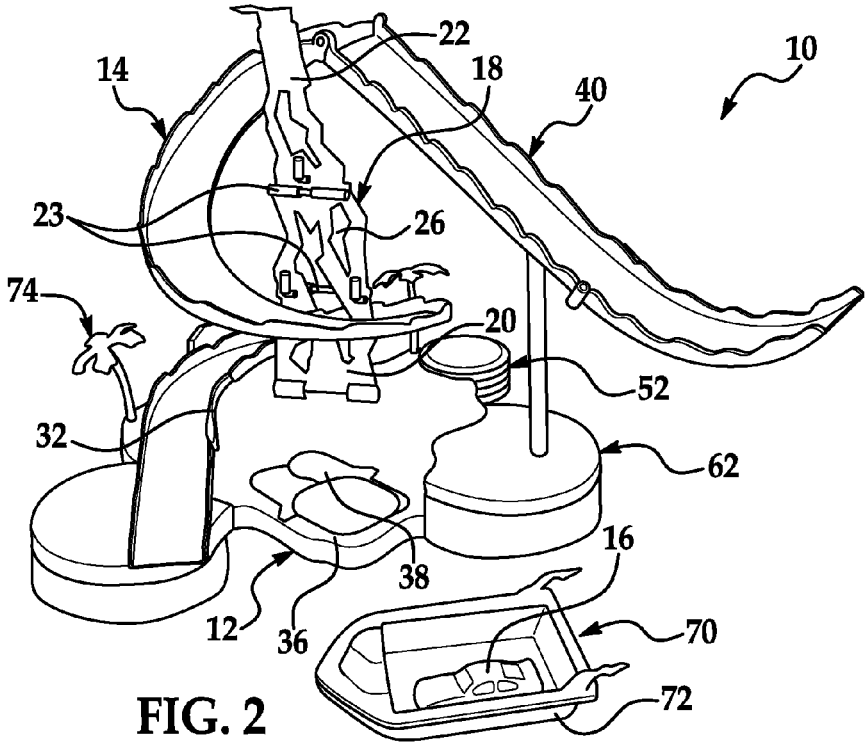
Figure 3:
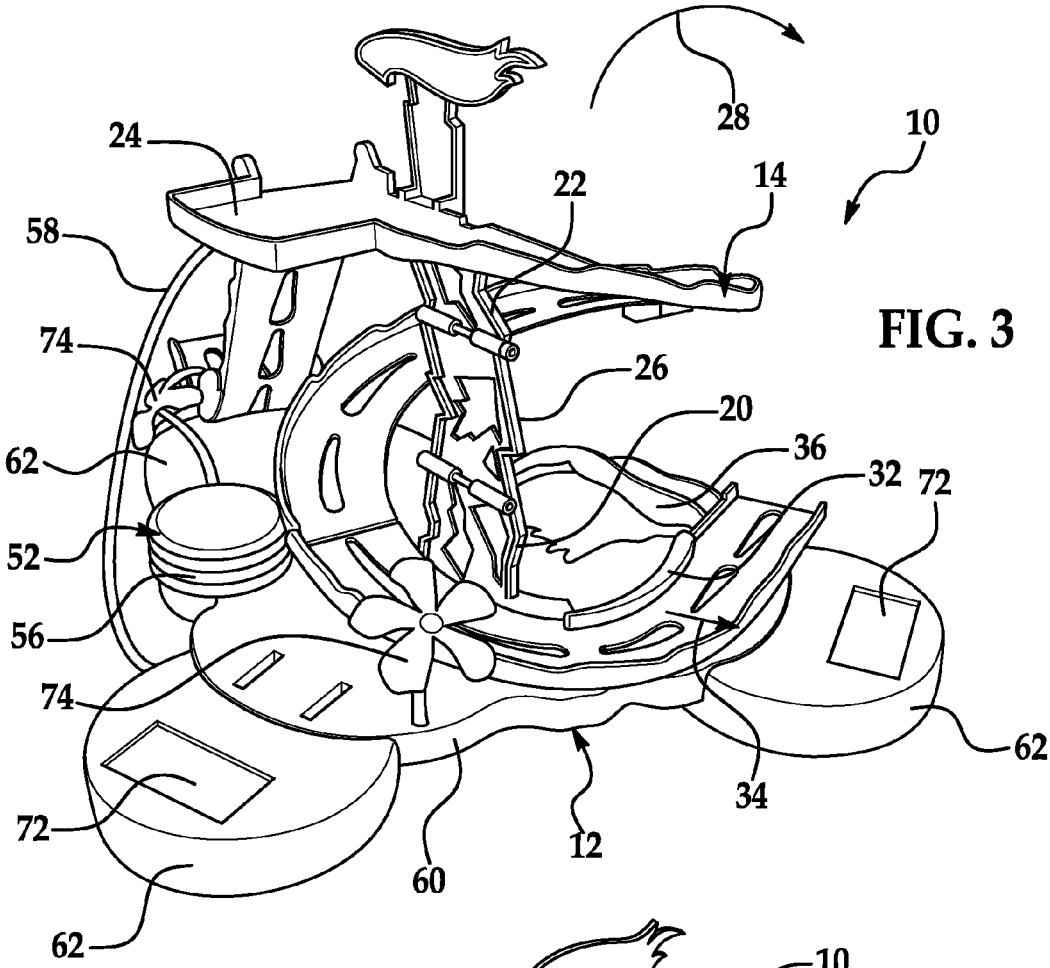
Figure 4:
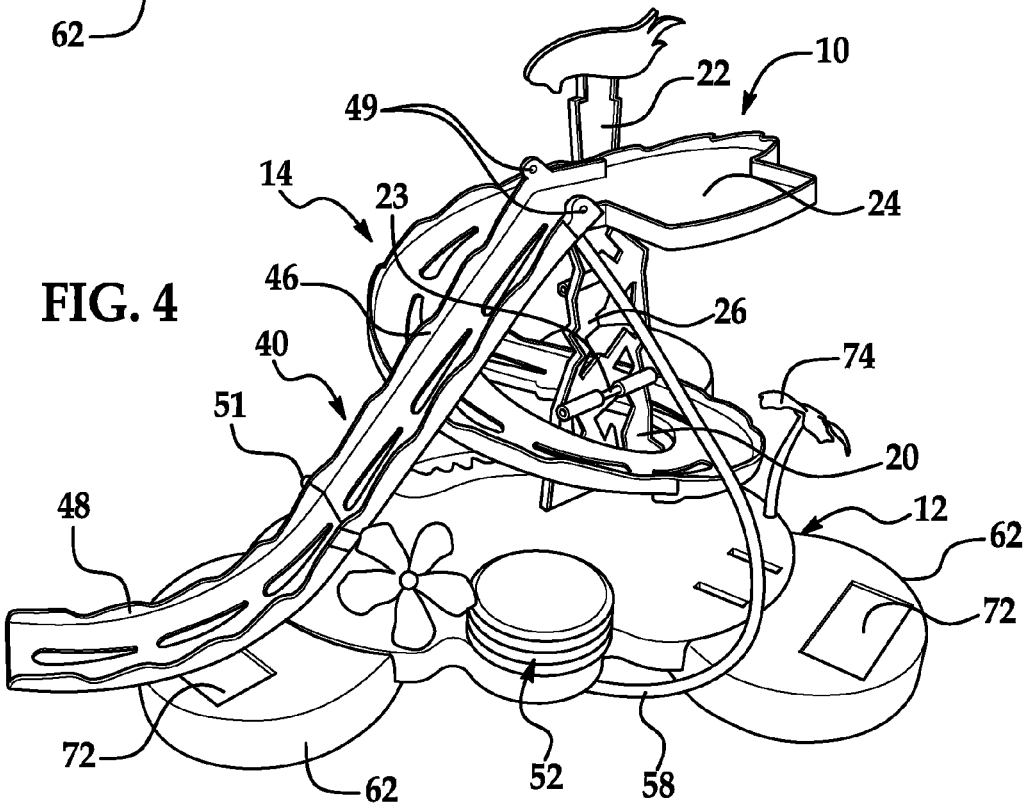

In accordance with various embodiments of the present invention and referring now to FIGS. 1-13, a floatable toy structure 10 is illustrated. As illustrated, the floatable toy structure has a floatable base portion 12 and a collapsible track section 14 secured to the floatable base portion. The collapsible track section is generally curved to provide a spiral path for an object 16 such as a toy vehicle to travel down. As illustrated in the attached FIGS. the collapsible track section is capable of being positioned in an extended position FIGS. 1-4 and 7-9 and a stowed position FIGS. 10 and 11. The collapsible track section extends upwardly from the floatable base portion when it is in the extended position to provide a path for an object to travel down and splash into the water that the toy structure is floating in. Of course, any other releasable means for securing the collapsible support and the collapsible track section in their extended positions is contemplated.

In order to support the collapsible track section in the extended position, a collapsible support 18 is secured to the floatable base portion. The collapsible support being capable of being positioned in an extended position FIGS. 1-4 and 7-9 and a stowed position FIGS. 10 and 11. Similarly to the collapsible track section the collapsible support extends upwardly from the floatable base portion when it is in the extended position. In order to maintain the collapsible track section in the extended position, the collapsible support engages and maintains the collapsible track section in the extended position when the collapsible support is in the extended position. For example, a hook member of the collapsible track section engages a catch of the collapsible support. Of course, any other suitable means for securement between the collapsible track section and the collapsible tower section is contemplated.

As illustrated, the collapsible support has at least a lower or first member 20 and an upper or second member 22 each being pivotally secured to each other by for example, a plurality of pins 23 of course, any other equivalent structure may be used to pivotally secure the members of the collapsible support. The first member is also pivotally secured to the floatable base portion and the second member is configured to engage and support a portion or platform 24 of the collapsible track section. In one embodiment a third or middle member 26 is disposed between the first and second members such that the first member is pivotally secured to the middle member at one end and the second member is pivotally secured to the middle member at another end. In addition and in one embodiment, the first member and the second member are configured such that pivotal movement of the first member with respect to the base portion and pivotally movement of the second member with respect to the first portion in the direction of arrow 28 is limited by for example surfaces and/or angular configurations of the first member and the second member such that a downward force in the direction of arrow 30 by for example the collapsible track section will maintain the collapsible support in the upright or extended position.

In one non-limiting exemplary embodiment, the floatable toy structure is formed from an easily molded material such a plastic and the collapsible track section is formed from a material having resilient characteristics such that it can be extended from the stowed position to the extended position and the collapsible track section will have a tendency to apply a downward force in the direction of arrow 30 when in the extended position such that the collapsible track section and the collapsible support are maintained in the extended position when portion 24 engages the second member of the collapsible support.

Figure 10:
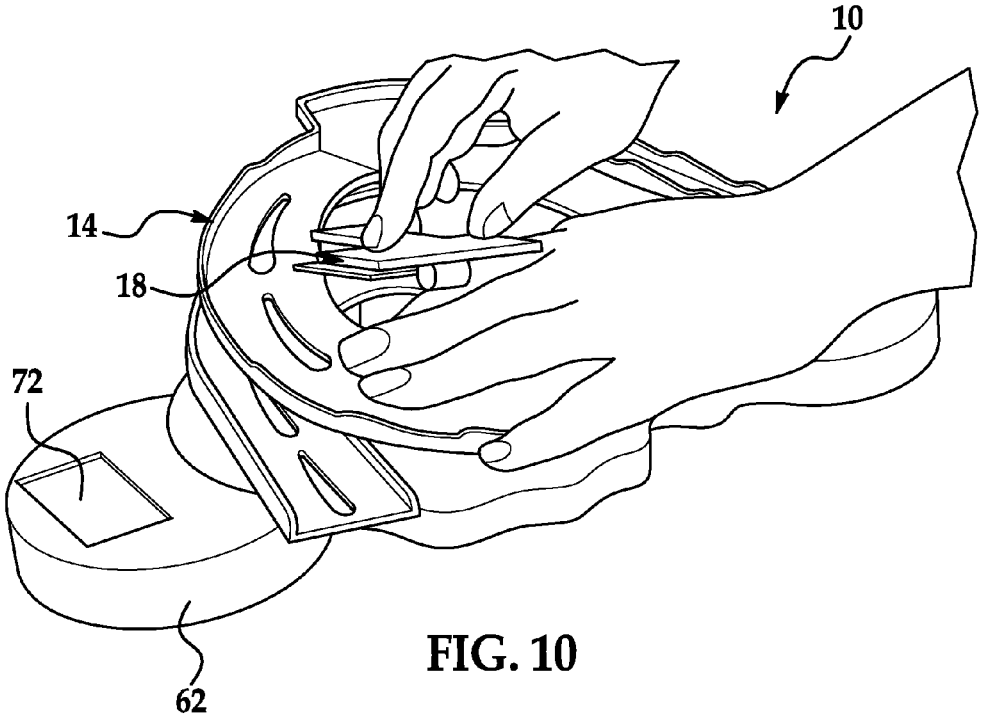
FIGS. 10 and 11 illustrates the toy structure in a collapsed or stowed configuration.
Figure 11:
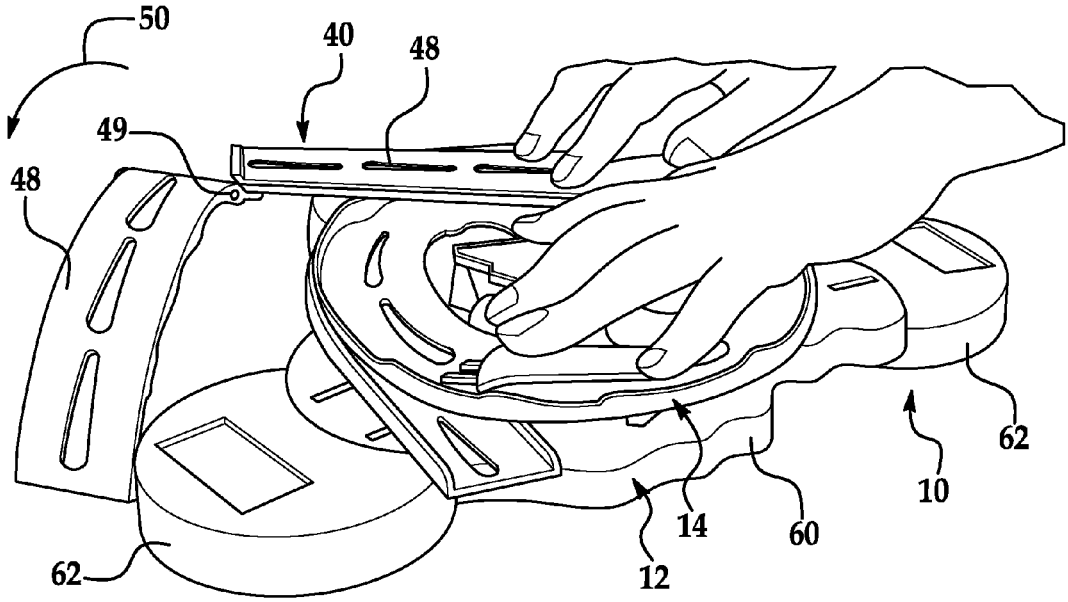

In order to stow the floatable toy structure a user simply applies a force to the collapsible track section in a direction opposite to arrow 30 so as to disengage portion 24 from the collapsible support by moving the same slightly upward and away from the collapsible track section and then collapsible support and track section are free to collapse thereby allowing the floatable toy structure to be placed in the configuration of FIGS. 10-11.

As illustrated in FIGS. 1-3 and 7, a diverter section 32 is pivotally mounted to a portion of the collapsible track section for movement between a first position wherein the diverter section allows a car to travel down the collapsible track section and a second position wherein the diverter section is moved into the track in the direction of arrow 34 and an object (e.g., toy car) travelling down the collapsible track section will be diverted from the collapsible track section and into an opening 36 disposed in the floatable base portion of the floatable toy structure. In one embodiment, the diverter section has a curved configuration to divert the car off of the track and into the opening. In essence, diverter section 32 is a switch track for altering the path of an object (e.g., toy car or other item) travelling down the collapsible track section.

In one embodiment, the opening 36 is shaped to resemble a shark's or other creature's mouth. In still another embodiment, the opening 36 has a collapsible trap door 38 that opens when the object (e.g., toy car or other item) hits it.

As illustrated, the floatable toy structure also has another track section 40 pivotally secured to the collapsible track section for example platform 24 such that a downward path 42 from the platform 24 is provided when the collapsible track section is in the extended position. Track section 40 is also adjustably and removably secured to the floatable base portion at another location remote from the point of pivotal securement to the collapsible track section via an extendable support 44 to provide adjustable configurations of track section 40 as illustrated by the dashed lines in FIG. 7. Accordingly, an adjustable path or jump with adjustable heights for an object (e.g., toy car or other item) to travel down is provided.

Figure 9:
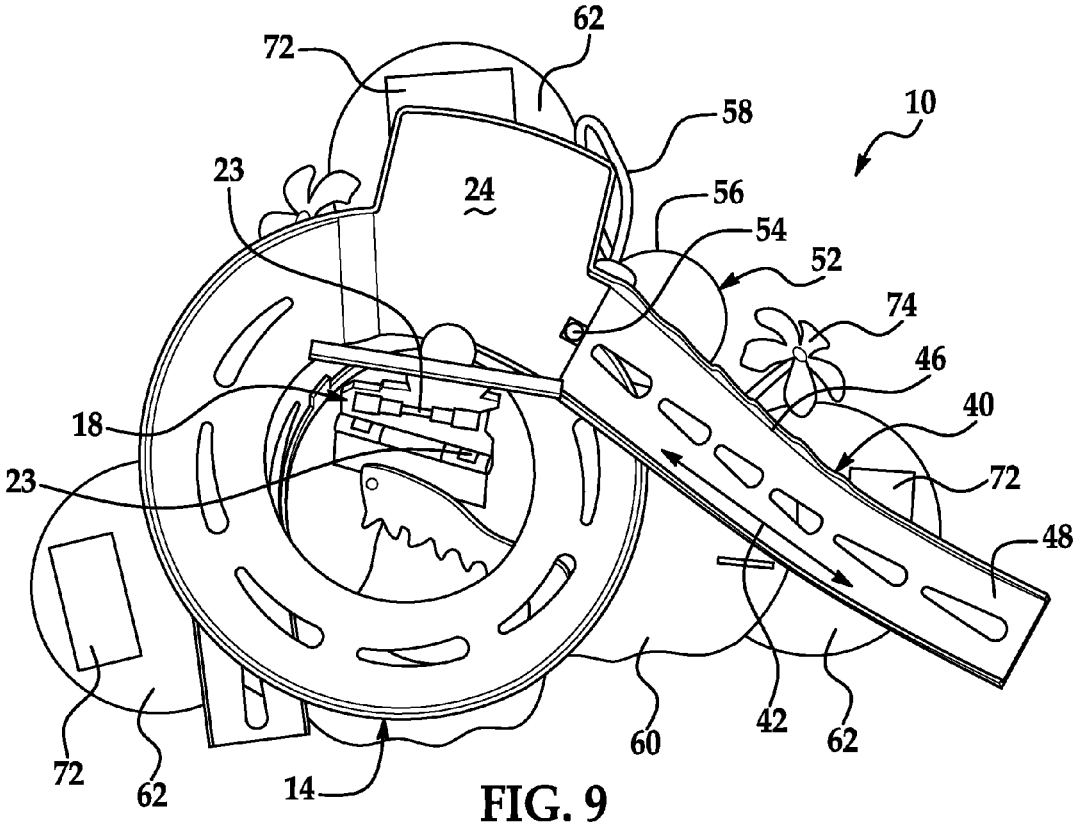
FIG. 9 is a top view of the toy structure of exemplary embodiments of the present invention.

Referring now to FIGS. 4, 7, 9 and 11, track section 40 has an upper portion 46 and a lower portion 48, the upper portion being pivotally secured to the collapsible track section at for example, the platform via mounting pins 49 or any other equivalent structure at one end and the lower portion being removably and adjustably secured to the floatable base portion via support 44 at another location remote from the pivotal securement to the collapsible track section. In addition, the lower portion is also pivotally secured to the upper portion via a mounting pin or equivalent structure such that the same may be pivoted away from the upper portion to allow for stowing of the floatable toy structure as illustrated in FIGS. 9 and 11. Moreover, the pivotal securement of the upper portion to the collapsible track section allows the same to be pivoted in the direction of arrow 50 away from its deployed position FIGS. 1-4, 7, 8 and 9 to the stowed position FIGS. 10 and 11.

Referring to at least FIGS. 1, 4-6, 8 and 9 and in accordance with an exemplary embodiment of the present invention and since the floatable toy structure is intended for use in a body of water, the floatable toy structure further comprises a pump 52 for spraying water from a spray nozzle 54 secured to the floatable toy structure. FIG. 1 illustrates a plume 55 of water being sprayed by spray nozzle 54. In one embodiment, the pump is a compressible bellows 56 secured to the floatable base portion and the spray nozzle 54 is secured to an upper portion the collapsible track section and a flexible conduit 58 fluidly connects the pump to the spray nozzle.

Figure 5:
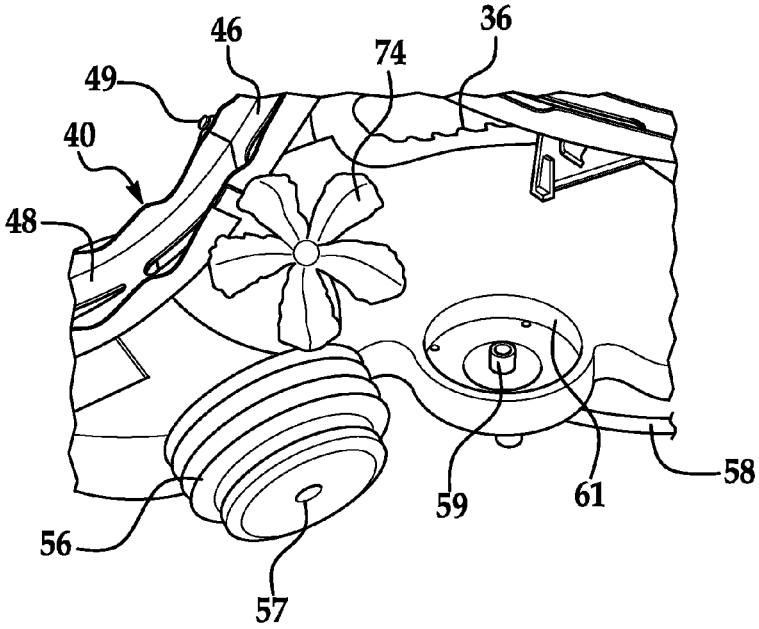
FIGS. 5 and 6 illustrate a pump of the toy structure illustrated in FIGS. 1-4.

As shown in FIG. 5, the bellows has an opening 57 configured to engage a conduit 59 disposed in a recessed area 61, wherein fluid in bellows 56 is pumped into conduits 59 and 58. Although, a bellows type pump is illustrated any other manual type pump may be employed to pump water into conduit 58 and spray it from nozzle 54.

Figure 6:
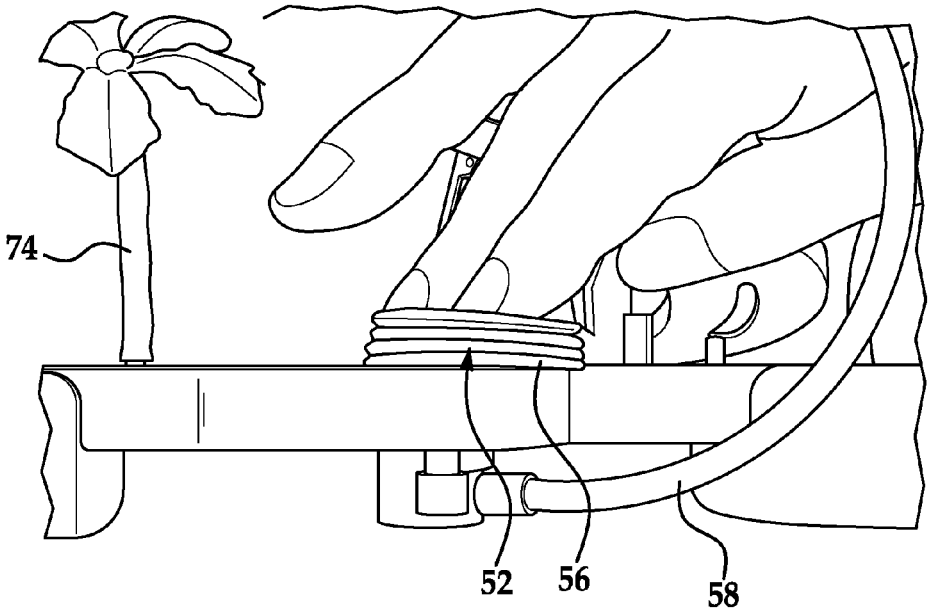
Figure 7:
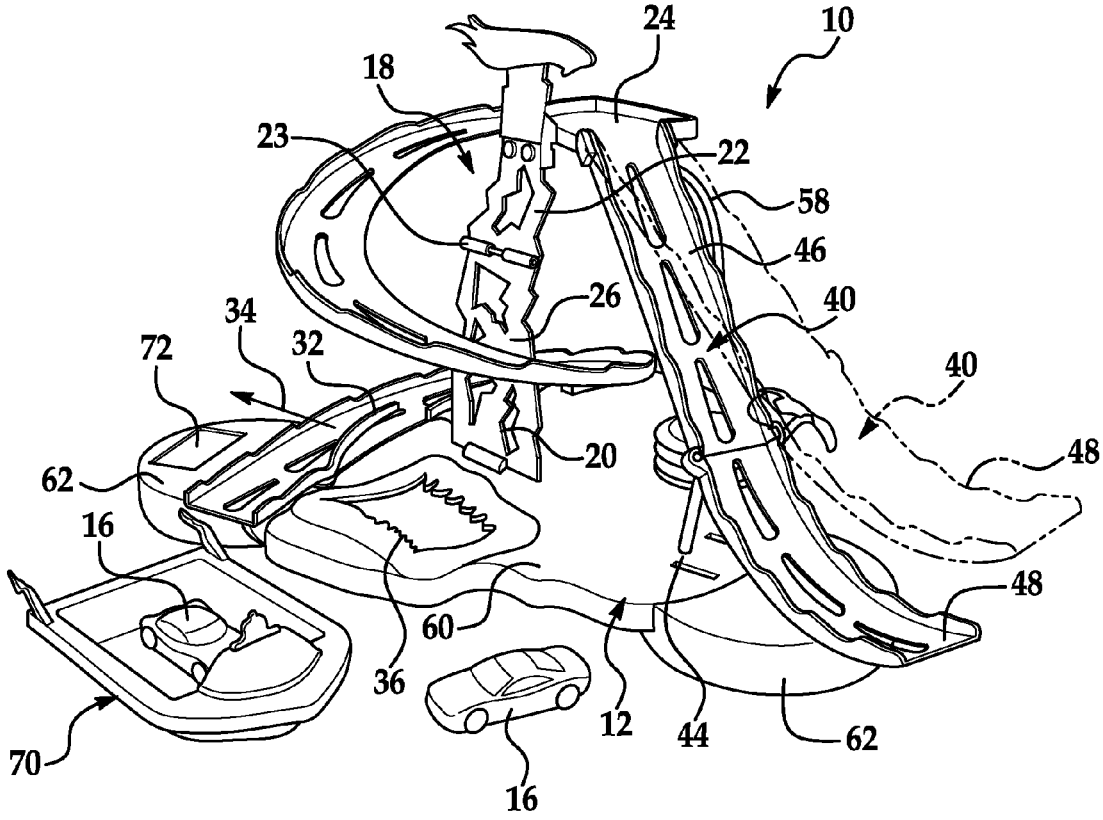
FIG. 7 is a perspective view of the toy structure illustrating operation thereof.
Figure 8:
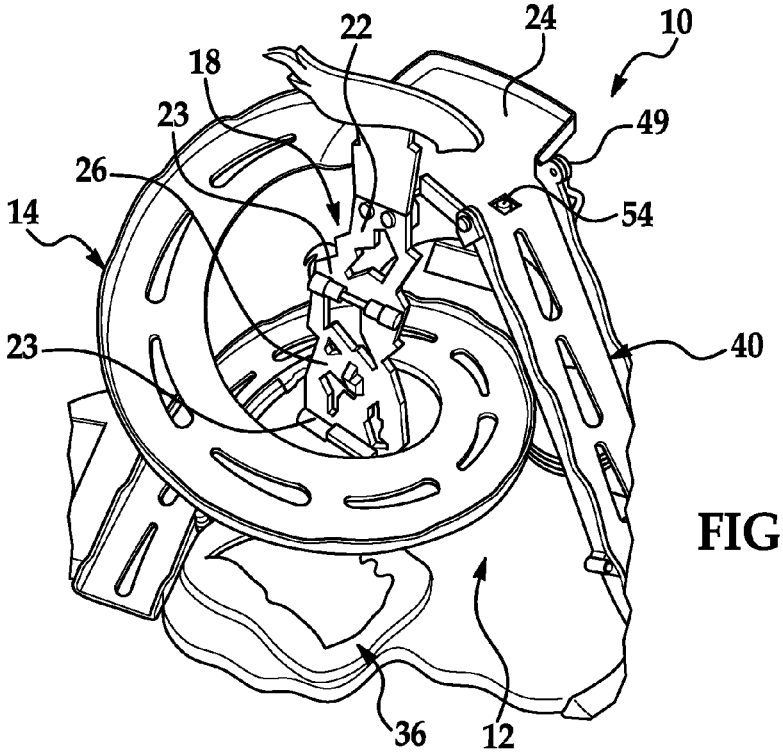
FIG. 8 is a top perspective view of the toy structure.

Accordingly and as a user presses the bellows to a compressed state illustrated in FIG. 6, fluid in the bellows is pushed through the conduit and out nozzle 54. Thereafter and as the bellows expands a vacuum is created in the bellows and more fluid is drawn back into the bellows via a one way valve for expulsion back out of nozzle as the bellows is compressed once again. In one non-limiting exemplary embodiment, the one way valve is enclosed a housing 63 illustrated in at least FIG. 13, wherein the one way valve is in fluid communication with the body of water the floatable toy structure is placed in as well as the bellows to provide a means for pumping fluid to the nozzle from the pump.

As illustrated in the attached FIGS., the floatable base platform of the floatable toy structure comprises a base platform 60 and a plurality of floats 62 secured thereto in order to provide buoyancy to the floatable base platform. In one non-limiting embodiment, the floats are positioned to provide stability to the structure in both water and non-water play.

Figure 12:
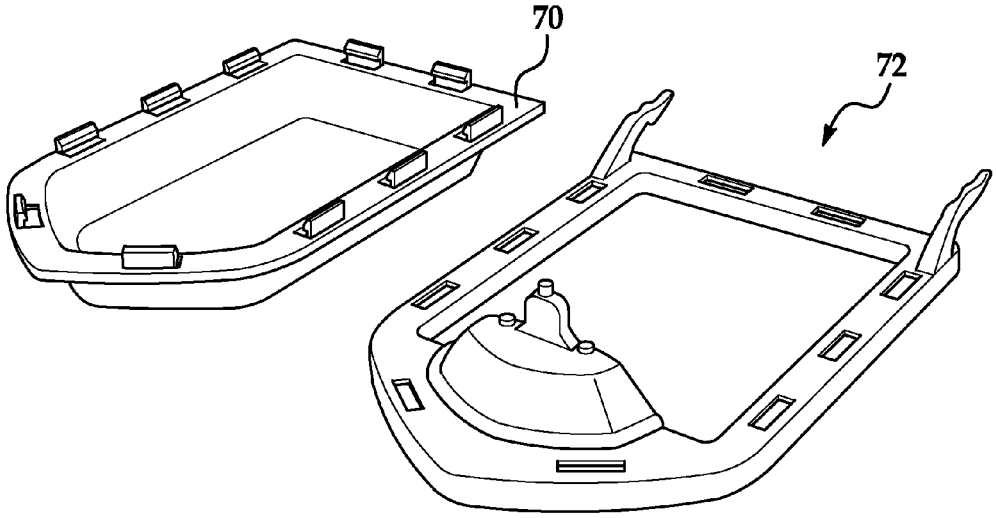
FIG. 12 illustrates an accessory for use with the toy structure.
Figure 13:
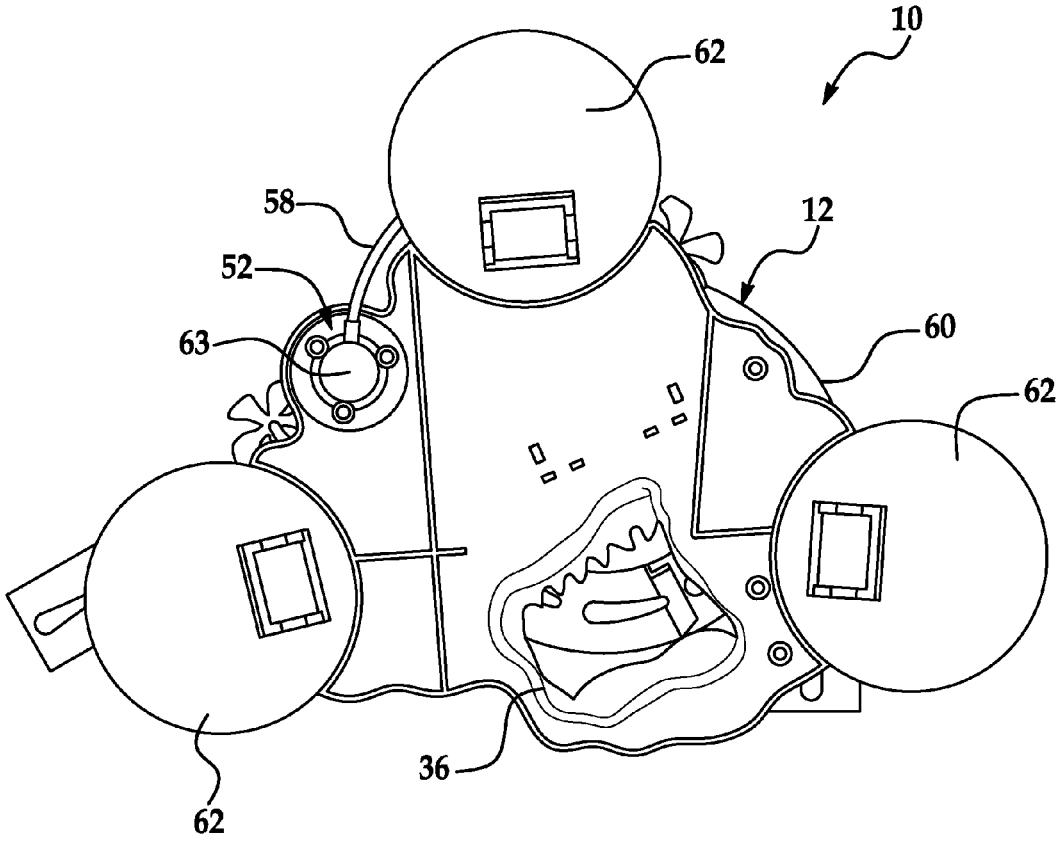
FIG. 13 is a bottom view of the toy structure of exemplary embodiments of the present invention.
Figure 14A:
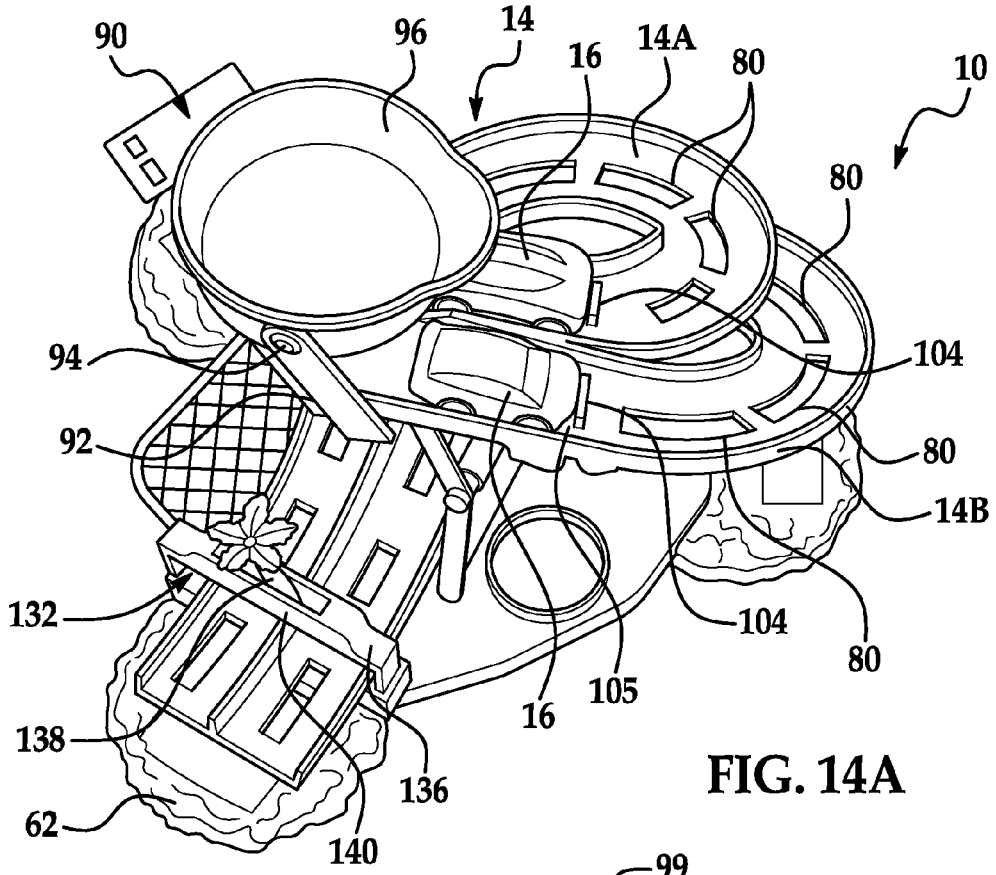
FIGS. 14A-15D illustrate an alternative exemplary embodiment of the present invention.
Figure 14B:
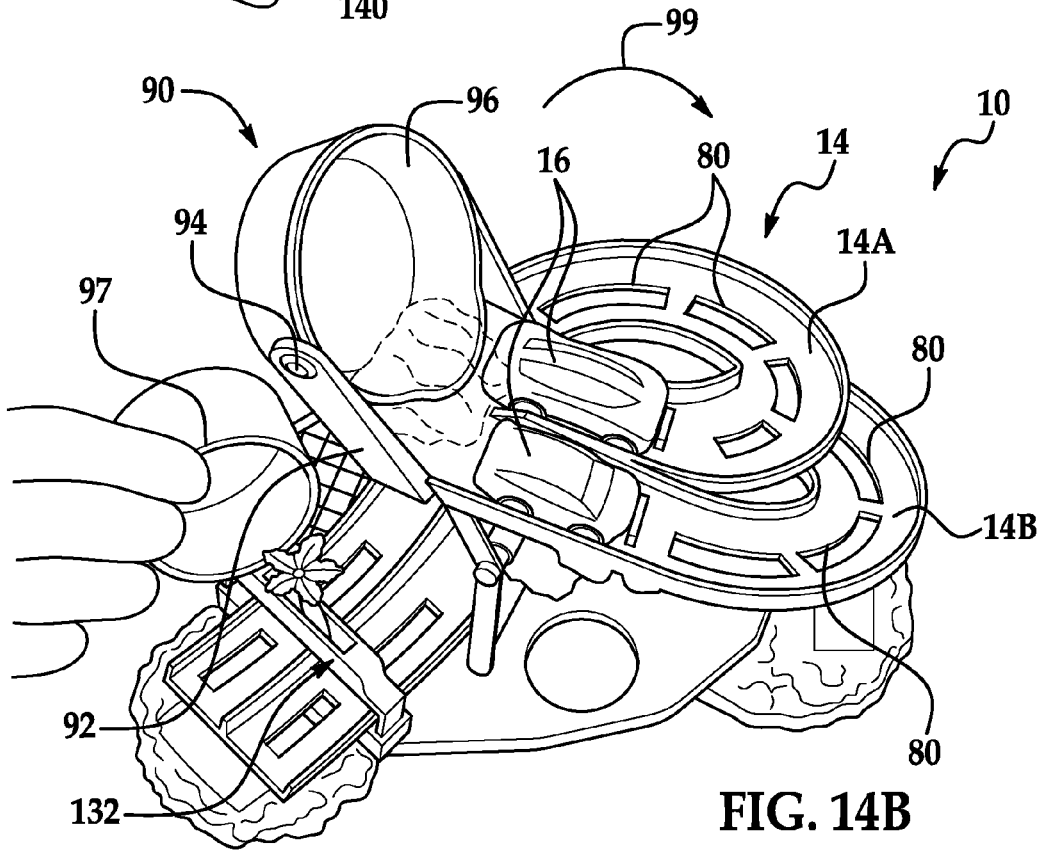

In addition, a toy boat 70 is also provided for use with the floatable toy structure. Toy boat 70 has a hull portion 72 with a see-though bottom so that a user may look in the body of water for vehicles that have travelled down the track paths of the floatable toy structure or passed into opening 36 via diverter 32. In addition, the boat provides an area into which vehicles travelling down track section 40 may received after they are launched into air thus providing a target for the user to aim their cars at which provides enhanced play. FIG. 12 shows boat 70 in an unassembled configuration. The floatable toy structure also has a plurality of spaces 72 for placement of toy cars or vehicles of objects so that a user may retain them there during play in a body of water. The numerous amount of spaces allows for many objects to be placed on the floating structure for enhanced play.

In one non-limiting embodiment, the floatable toy structure is configured to resemble an island with palm trees 74 and other decorative attachments for enhanced play.

Referring now to FIGS. 14A-15D, an alternative embodiment of the present invention is illustrated. Here, the collapsible track section 14 of the floatable toy structure 10 comprises more than one generally curved spiral path for objects to travel down. In the illustrated example, collapsible track section 14 has two paths or track sections 14A and 14B so that two objects, such as cars 16, may race each other to the bottom of the track section 14 via a respective track path or section. Both track sections are parallel to each other at the upper end or starting line of the collapsible track 14 and at the lower end or finish line of the collapsible track section. Of course, numerous other configurations are contemplated to be within the scope of exemplary embodiments of the present invention. As illustrated, the track sections 14A and 14B may diverge from each other between the starting and finish line. Of course and in another embodiment, the track sections 14A and 14B may be parallel to each other for the entire track length. The collapsible track section 14 may also have openings 80 along its length sized such that a liquid but not an object 16 meant for use with the floatable toy structure may pass through the openings 80.

In this embodiment, the floatable toy structure has a "fair start" mechanism 90 that allows two objects 16 to be simultaneously released down a respective one of the track sections 14A and 14B so that the objects 16 can race each other due to the gravity forces pulling them down the tracks. For example and in one embodiment, the objects 16 are toy vehicles configured to roll along a track section.

Positioned on the upper end of the collapsible track section 14 is a support or pair of supports 92 that cooperate with pins or other fastening means 94 for pivotally mounting a bucket or other container 96 to the support or supports 92 at a position above the upper end of the collapsible track section 14. The bucket 96 is pivotally mounted to the support or supports 92 so that it may transition from a first upright position illustrated in at least FIG. 14A to a second tilted position illustrated in at least FIG. 14B after a user has filled the bucket with a predetermined amount of water via a filling bucket 97 or any other suitable means. The bucket 96 is shaped or configured such that a center of gravity of the bucket changes as it becomes filled with water. For example and once the water level in the bucket exceeds a certain point, the bucket's center of gravity will change and the bucket 96 will pivot on the support or supports 92 and rotate in the direction of arrow 99 and pour water onto the cars 16 waiting to be released by the "fair start" mechanism 90. In an alternative embodiment, a user can simply pour water onto the "fair start" mechanism 90 with filling bucket 97 or any other suitable container or simply splash water onto the fair start mechanism 90 in order to release the cars 16 down the track sections.

The waiting cars 16 are held back at the top of the collapsible track section 14 by a starting device 100 of the fair start mechanism 90. The starting device 100 has a tray member 102 pivotally mounted to the collapsible track section 14 proximate to the top of the collapsible track section 14 for movement between a first or holding position, wherein two members 104 of the starting device 100 protrude through complimentary holes or slots 105 in the track sections 14A and 14B such that they are in the blocking position illustrated in FIG. 14. The blocking position of the members 104 causes them to contact a portion of the vehicle 16 in order to prevent them from travelling down the track sections. In one non-limiting embodiment, the tray member 102 is pivotally mounted to an underside of the collapsible track section 14 and the members 104 are secured to or integrally formed with the tray member 102. When the tray member 102 is in the first or holding position, the vehicles 16 are prevented from travelling down the track segments 14A and 14B due to the two members 104 of the starting device 100 protruding through slots 105 and thus being in a blocking arrangement. Since the starting device 100 has a blocking member 104 for each lane of the collapsible track section 14, a fair starting mechanism 90 is provided such that as the tray member 102 is moved from the first or holding position to a second or release position wherein each of the members 104 are simultaneously retracted within their complimentary holes or slots 105 of the track sections 14A and 14B and thus the cars 16 are simultaneously released for a race down the track segments. When the water spills out of the bucket 96 as it rotates in the direction of arrow 99, the water spills over the cars and falls through the track segments 14A and 14B via openings 80 onto the tray member 102 of the starting device 100 such that the same is manipulated from the blocking position to the release position.

As the water cascades out of the bucket 96, it falls onto the objects or cars 16 and through openings 80 in the track segments onto a flat portion of the tray member 102, wherein the weight of the water causes the tray member 102 to pivot about its pivot axis 107 in the direction of arrow 109, causing the two members 104 to simultaneously descend into the slots 105 until they no longer contact and block the vehicles 16 such that they can now travel down the track sections and thus begin the race of the toy vehicles down the track sections 14A and 14B. Accordingly, a "fair start mechanism" 90 is provided by filling a pivotally mounted bucket 96 with a predetermined amount of water such that the bucket's center of gravity will change thus causing the bucket 96 to rotate and pour its contents onto two vehicles 16 waiting to be released by the starting device 100. As the water cascades around the vehicles 16 it will travel onto the tray member 102 causing the same to pivot about an axis 107 and thus cause members 104 to be retracted within their respective slots 105 of the track sections 14A and 14B. As mentioned above and in an alternative embodiment, a user can simply pour water onto the "fair start" mechanism 90 via any other suitable container or simply splash water onto the fair start mechanism 90 in order to release the cars 16 down the track sections.

In one non-limiting embodiment and as illustrated in the attached FIGS., tray member 102 has a peripheral wall portion 111 configured to define an area to contain water therein such that a sufficient amount of water is retained in order to transition the tray member 102 from the first position to the second position. In an exemplary embodiment, the peripheral wall portion 111 is configured to retain the water therein when the tray member 102 is in the first position and then release the water as the tray member 102 moves from the first position to the second position. The pivotal securement of the tray member 102 to the track section 14 allows it to pivot about its pivot axis 107 and move in the direction of arrow 109 such that one end of the tray member 102 remote from the pivot axis 107 is lower than the other end proximate to the pivot axis 107 and the water retained in the tray member is released due to the lowering or release of one end of the tray member 102.

In one embodiment, the starting device 100 will default or return to the first or holding position unless a predetermined amount of water has been received on the tray member 102. This may be achieved by a biasing member or spring 110 that provides a biasing force in a direction opposite to arrow 109 to return the tray member 102 to the first position after the water has poured out of tray member 102 when it is in the second position. The tray member 102 is configured such that as it transitions from the first position to the second position by a predetermined amount of water received upon the tray member 102 the water will pour or cascade off of the tray member 102 such that it can return to the first or holding position by the biasing force of spring or biasing member 110. Alternatively, the tray member 102 can be configured without a biasing member and simply be manipulated into the first position by a user wherein a feature 115 of the tray member is configured to frictionally engage another complimentary feature or features 117 of the collapsible track section 14 such that the frictional engagement will be sufficient to retain the tray member 102 in the first position such that members 104 protrude through slots 105 and are in the blocking position until a predetermined amount of weight is received thereon due to the water being poured on the tray member and thus the frictional engagement between the feature 115 of the tray member 102 and its complementary feature or features 117 of the track section 14 will be overcome and the tray member will pivot in the direction of arrow 109 into the second or release position and thus retract the members 104 into slots 105 such that they are no longer in a blocking position and the toy vehicles can travel down the track sections 14A and 14B. In one non-limiting embodiment, feature 115 is a tab member that is frictionally engaged between a pair of tabs or wall portions 117. In still yet another alternative embodiment, each tab member 104 coupled to the tray member 102 is configured to have a feature 119 configured to frictionally engage a peripheral portion of slot 105 in order to retain the tray member 102 in the first position until a predetermined amount of water is received in the tray member 102 in order to cause it to transition from the first position to the second position. It being understood that any of the previous configurations for retaining tray member 102 and members 104 in the first position and subsequently releasing the same into the second position and retract members 104 into slots 105 due to water being applied to the tray member 102 can be used alone or in combination with each other and equivalent mechanisms are also considered to be with the scope of exemplary embodiments of the present invention.

In other words, the tray member 102 of the starting device 100 has a means or mechanism for retaining the tray member 102 and the member 104 in the first position until a predetermined amount of water is received onto the tray member 102 and thus cause it to transition from the first position to the second position wherein each of the members 104 are simultaneously retracted into the slots 105 to allow for both cars to be simultaneously released and thus provide a "fair start" mechanism.

Although two track sections 14A and 14B are illustrated in the attached drawings it is contemplated that a "fair start" mechanism for numerous track sections greater or less than two are considered to be within the scope of various embodiments of the present invention.

Figure 15A:
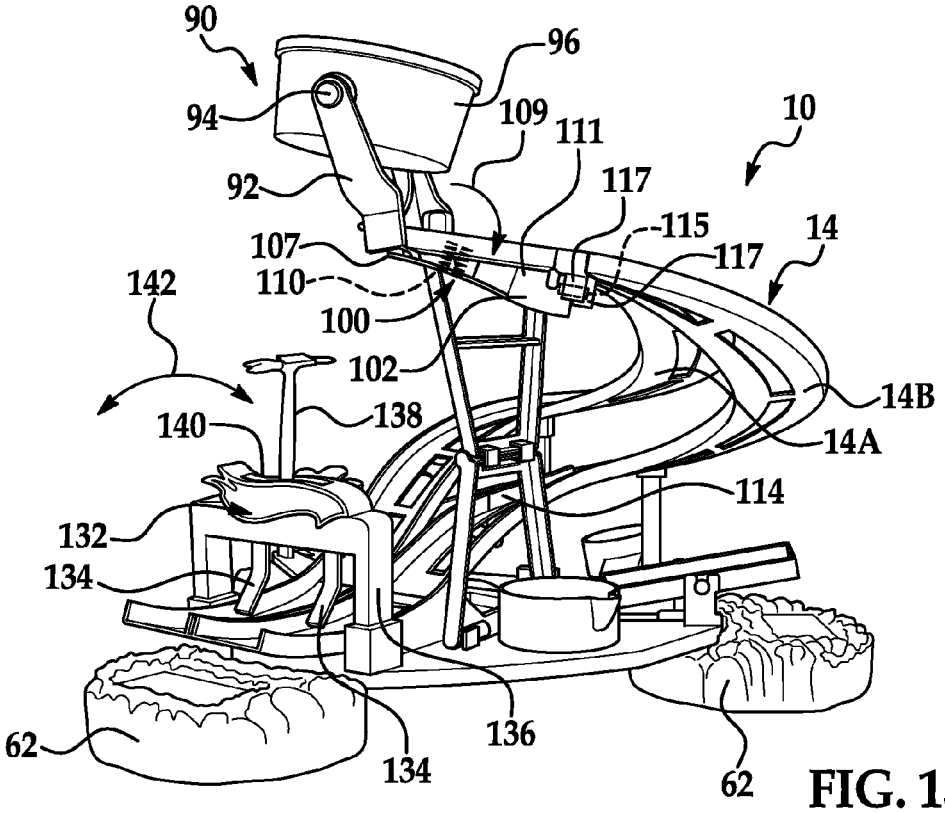
Figure 15B:
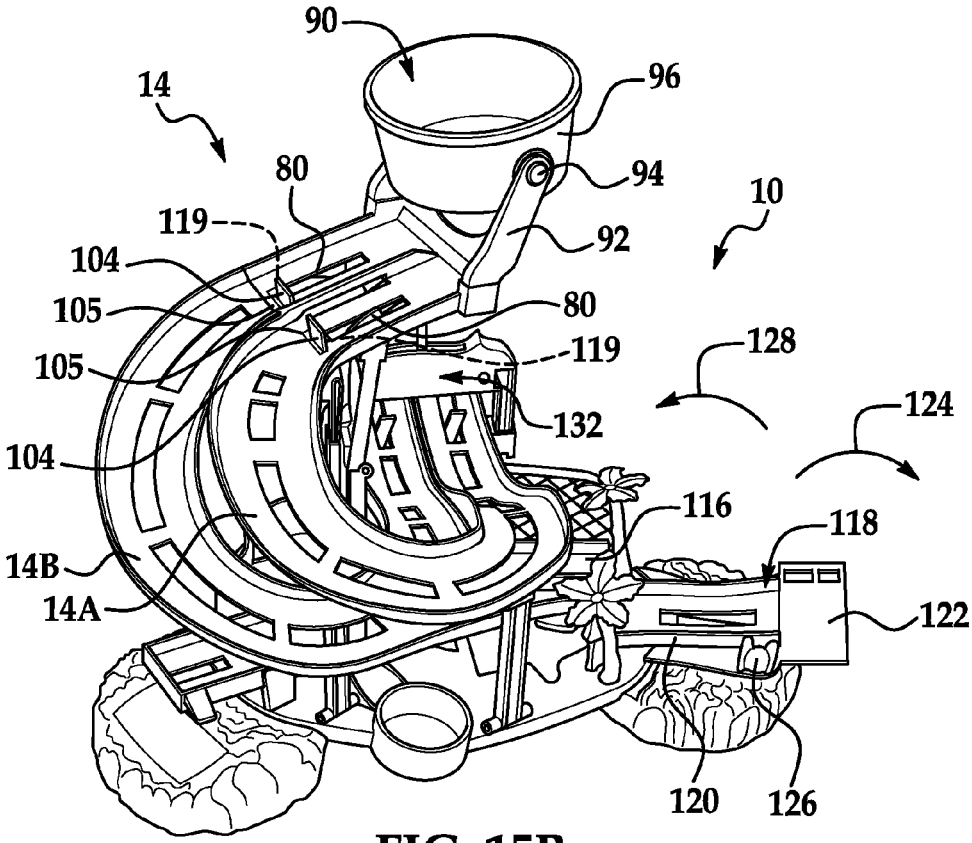
Figure 15C:
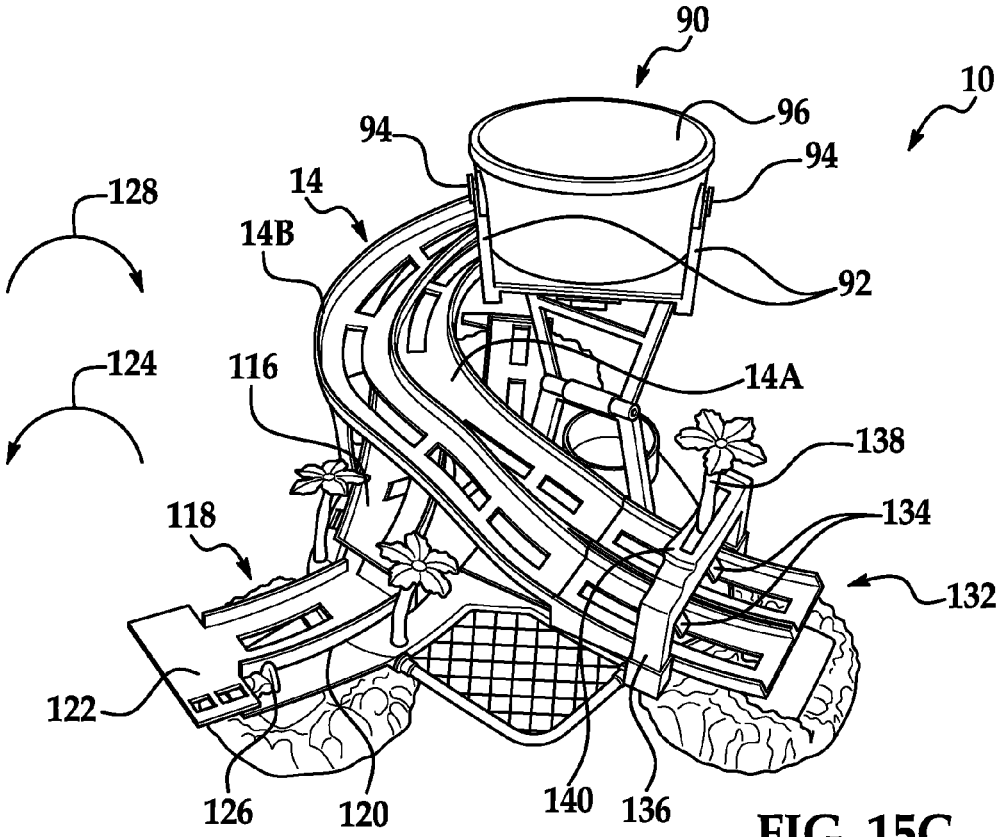
Figure 15D:
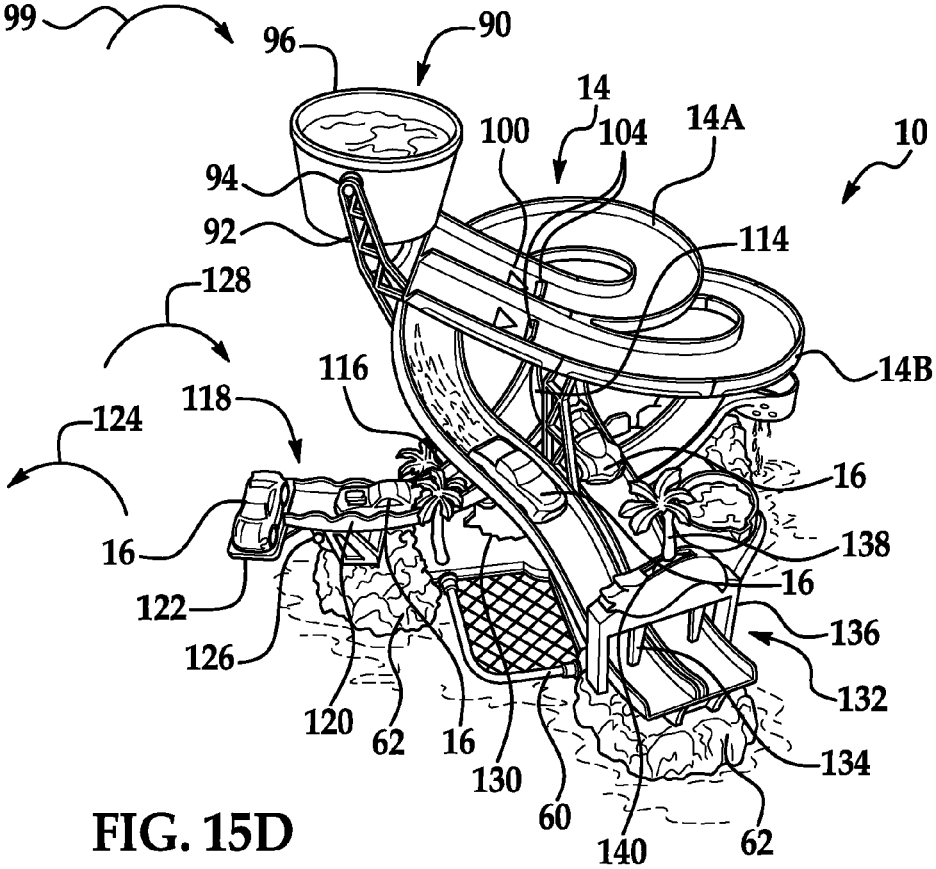

Also illustrated in the attached FIGS., is that one of the track sections is provided with a diverter 114 that is pivotally mounted to a track section such that it may be moved between a first position wherein an object 16 travels from the starting line to the finish line along the track section and a second position wherein an object traveling from the starting line will be diverted to an ancillary or alternative track section 116. Ancillary or alternative track section 116 directs the vehicle or object 16 towards a teeter totter track segment 118 that is pivotally mounted to one of the plurality of floats 62 or other location of the floatable toy structure 10. As illustrated in the attached FIGS., the teeter totter track segment 118 has a first section 120 and a second section 122. As illustrated in FIG. 15D, when an object 16 is diverted to ancillary track section 116 it will be received upon the teeter totter track segment 118 via first section 120.

In one embodiment, a second object or toy vehicle 16 is located on the second section 122 such that as the first vehicle travels along the first section 120 it will contact the second vehicle on the second section 122 and knock it off the teeter totter segment 118 in the direction of arrow 124. Due to the arrangement of the first section 120 and the second section 122 removal of the vehicle from the second section 122 will cause the teeter totter segment 118 to be unbalanced about its pivot axis 126 such that the teeter totter segment 118 will rotate in the direction of arrow 128 and thus cause the car or object 16 on the first track section 120 to travel into an opening 130 of a base platform 60 of the floatable toy structure 10. This movement is facilitated by the movement of the teeter totter segment 118 into a position wherein the first track section 120 is inclined outwardly towards opening 130 of base platform 60.

Accordingly, the "teeter totter" switch or segment 118 is configured to have a vehicle 16 parked on the end of the switch platform on the second track section 122 such that it is held in one orientation, which locates the first track section 120 to be located such that it can receive a vehicle or object 16 from the ancillary track section 116. As a vehicle 16 travels onto the first track section it will knock the vehicle off the second track section 122 causing the "teeter totter" switch or segment 118 to rock or pivot to another position in the direction of arrow 128, such that the car 16 on track section 120 will fall into a body of water the floating toy structure 10 is floating on via opening 130 in platform 60.

Also illustrated in the attached FIGS. is a mechanism 132 for determining the winner of the race. Here a pair of members 134 are pivotally mounted to a structure 136 for pivotal movement with respect to the structure 136 and wherein the pair of members 134 and the structure 136 define a finish line of the race such that when the first object or toy car 16 passes through the structure 136 it will contact one of the members 134 and cause an indicator 138 to indicate which track had the first car pass through the finish line. Indicator 138 is pivotally mounted to the structure 136 and passes through a slot 140 configured to allow the indicator 138 to move in the directions of arrows 142. In one embodiment, indicator 138 is coupled or linked to members 134 such that movement of one of the members 134 will cause a corresponding movement of indicator 138. In one embodiment, the indicator 138 is held in the upright position illustrated in at least FIG. 15A and the first member 134 to be moved by a car 16 passing through the finish line will allow or cause the indicator 138 to pivot or move towards the lane or track having the first moved member by pivoting and moving within slot 140 and thus indicating the winner of the race. Of course, other equivalent mechanisms for indicating the winner of the race are considered to be within the scope of exemplary embodiments of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A floatable toy structure, comprising:

a floatable base portion;

a collapsible track section secured to the floatable base portion, the collapsible track section capable of being positioned in an extended position and a stowed position, the collapsible track section extending upwardly from the floatable base portion when it is in the extended position, the collapsible track section having a pair of track sections;

a collapsible support secured to the floatable base portion, the collapsible support capable of being positioned in an extended position and a stowed position, the collapsible support extending upwardly from the floatable base portion when it is in the extended position, the collapsible support engages and maintains the collapsible track section in the extended position when the collapsible support is in the extended position; and a fair start mechanism for simultaneously releasing a pair of objects for travel down the pair of track sections, wherein the fair start mechanism comprises a bucket that spills water onto the pair of objects after a predetermined amount of water has been placed into the bucket.

2. The floatable toy structure as in claim 1, wherein one of the pair of track sections has a diverter section pivotally mounted thereto for movement between a first position and a second position, wherein an object travelling down the one of the pair of track sections will be diverted into an ancillary track section coupled to a teeter totter track segment.

3. The floatable toy structure as in claim 1, wherein the collapsible track section is configured for use with a toy vehicle.

4. The floatable toy structure as in claim 1, wherein the bucket is pivotally mounted to a support such that a center of gravity of the bucket changes as the bucket is filled with water.

5. The floatable toy structure as in claim 1, wherein the fair start mechanism further comprises a starting device pivotally mounted to the collapsible track section for movement between a first position, wherein two members of the starting device protrude through complimentary holes in the pair of track sections and a second position, wherein the two members of the starting device are retracted through the complimentary holes in the pair of track sections such that they no longer protrude the holes in the pair of track sections.

6. The floatable toy structure as in claim 5, wherein the bucket is pivotally mounted to a support such that a center of gravity of the bucket changes as the bucket is filled with water.

7. The floatable toy structure as in claim 5, wherein the starting device is a tray member pivotally mounted to an underside of the collapsible track section.

8. The floatable toy structure as in claim 7, wherein the pair of track sections further comprises a plurality of openings configured to allow water to pass from the bucket onto the tray member.

9. The floatable toy structure as in claim 8, wherein one of the pair of track sections has a diverter section pivotally mounted thereto for movement between a first position and a second position, wherein an object travelling down the one of the pair of track sections will be diverted into an ancillary track section coupled to a teeter totter track segment.

10. The floatable toy structure as in claim 9, wherein the pair of objects are toy vehicles and the tray member further comprises a peripheral wall.

11. The floatable toy structure as in claim 10, wherein the tray member is configured to return to the first position unless a predetermined amount of water has been received on the tray member.

12. The floatable toy structure as in claim 8, wherein the bucket is pivotally mounted to a support such that a center of gravity of the bucket changes as the bucket is filled with water.

13. The floatable toy structure as in claim 1, wherein the floatable base portion comprises a base platform and a plurality of floats secured thereto.

14. The floatable toy structure as in claim 1, wherein the collapsible support comprises at least a first member and a second member each being pivotally secured to each other, wherein the first member is also pivotally secured to the floatable base portion and the second member is configured to engage and support a portion of the collapsible track section.

15. The floatable toy structure as in claim 14, wherein the collapsible track section is configured as a spiral path.

16. The floatable toy structure as in claim 1, further comprising a teeter tooter track segment pivotally mounted to the floatable toy structure, wherein the teeter totter track segment has a first section and a second section, the first section being configured to receive an object from the collapsible track section and direct the object toward the second section such that as the object travels along the first section it will contact the another object on the second section and knock it off the teeter totter segment, wherein the movement of the another object from the second section will cause the teeter totter segment to be unbalanced about a pivot axis such that the teeter totter segment will rotate into a different position.

17. The floatable toy structure as in claim 16, wherein the different position causes the first track section to be inclined towards an opening in the floatable base platform of the floatable toy structure.

18. A floatable toy structure, comprising:

a floatable base portion;

a collapsible track section secured to the floatable base portion, the collapsible track section capable of being positioned in an extended position and a stowed position, the collapsible track section extending upwardly from the floatable base portion when it is in the extended position, the collapsible track section having a pair of track sections;

a collapsible support secured to the floatable base portion, the collapsible support capable of being positioned in an extended position and a stowed position, the collapsible support extending upwardly from the floatable base portion when it is in the extended position, the collapsible support engages and maintains the collapsible track section in the extended position when the collapsible support is in the extended position; and a fair start mechanism for simultaneously releasing a pair of objects for travel down the pair of track sections, wherein the fair start mechanism comprises a bucket that spills water onto the pair of objects after a predetermined amount of water has been placed into the bucket, wherein the spilled water is received onto a tray member pivotally mounted to an underside of the collapsible track section and the tray member pivots from a first holding position to a second release position such that the pair of objects are released down the pair of track sections when the tray member is in the second release position.

19. The floatable toy structure as in claim 18, wherein the tray member has a pair of members that are drawn into a pair of slots of the pair of track sections when the tray member is moved from the first position to second position.

20. A method for simultaneously, releasing a pair of toy vehicles down a pair of track sections of a floatable toy structure, comprising:

pivotally mounting a bucket to a support of the floatable toy structure, wherein the bucket is configured to change its center of gravity as the bucket is filled with water;

pivotally mounting a tray member to an underside the pair of track sections, wherein the tray member pivots from a first holding position to a second release position such that the pair of vehicles are released down the pair of track sections when the tray member is in the second release position; and moving the tray member from the first holding position to the second release position by pouring water from the bucket onto the tray member, wherein the tray member has a pair of members that are drawn into a pair of slots of the pair of track sections when the tray member is moved from the first position to second position.

* * * * *